United States Patent [19]

Willson

[11] Patent Number: 4,600,909

[45] Date of Patent: Jul. 15, 1986

[54] BIFURCATED CONTACT ARM IN A MINIATURE RELAY

[75] Inventor: James R. Willson, Ashland, Mass.

[73] Assignee: AMF Incorporated, White Plains, N.Y.

[21] Appl. No.: 735,905

[22] Filed: May 20, 1985

[51] Int. Cl.[4] ..... H01H 63/02; H01H 67/02

[52] U.S. Cl. ..... 335/133; 335/78; 335/83; 335/128; 335/129; 200/159 A

[58] Field of Search ..... 335/83, 128, 129, 133, 335/135, 78; 337/354; 200/159 A, 284

[56] References Cited

U.S. PATENT DOCUMENTS

| | | | |
|---|---|---|---|
| 4,177,367 | 4/1979 | Tirone | 200/159 |
| 4,339,734 | 7/1982 | Minks | 335/78 |
| 4,344,103 | 8/1982 | Nagamoto | 361/160 |
| 4,528,541 | 9/1985 | Hollweck | 337/354 |

*Primary Examiner*—E. A. Goldberg

*Assistant Examiner*—Lincoln Donovan

*Attorney, Agent, or Firm*—Willian Brinks Olds Hofer Gilson & Lione

[57] ABSTRACT

A miniature electromagnetic relay having a magnetic block and at least two sets of stationary electrical contacts. A moveable contact arm having a mounting end positioned in a base and two contact carrying portions extending from the mounting end. The improvement including a center tab portion on the moveable contact arm extending from the mounting end, between the extending contact carrying portions, and at a distance less than said contact carrying portions. The switching of the moveable arm from one set of electrical contacts to the opposite set being caused by the controlled energization of the magnetic block, which engages the tab of the moveable arm, causing closure of both contact carrying portions with the stationary electrical contacts at a lower electromagnetic force requirement and causing a more consistent relay operation.

4 Claims, 7 Drawing Figures

BIFURCATED CONTACT ARM IN A MINIATURE RELAY

This invention relates generally to the structure of miniature electromechanical relays such as those used by the telecommunications industry. Specifically, this invention relates to the structure of the moveable contact arm, which acts to switch electric power from one set of stationary contacts to another. An example of the miniature electromagnetic relay of the type contemplated by this invention is disclosed in U.S. Pat. No. 4,344,103 and also in commonly assigned co-pending U.S. Pat. application Ser. No. 698,301 filed on Feb. 5, 1985. Both of these references are herein incorporated by reference and should be considered as part of this disclosure.

The relays contemplated by this invention typically consist of bifurcated contacts; that is, an electrical contact area which is divided into two separate parts or portions. Conventional construction of these relays has at least one moveable bifurcated contact arm having electrical contacts on both sides of the arm to alternately engage one of two sets of bifurcated stationary contacts. Typically, this type relay has two moveable arms and stationary contact sets.

The switching action from the normally closed (NC) stationary contacts to the opposite, normally open (NO), stationary contacts causes a change in the electrical connection of the relay. The switching motion is performed by the energization of the relay coil which counters the magnetic force created by a permanent magnet to move and armature and pusher assembly away from the one moveable contact arm and against the opposite moveable contact arm. This pusher applied force must be large enough to counter the spring force of the moveable contact arm while properly closing the bifurcated contacts on ths opposite arm with those of the "pusher applied" stationary contacts. This closing is aided by the spring force of the first moveable arm as it returns to its "set" position upon the release of the pusher assembly by de-energization of the coil.

When the relay is in the NC or set position, one moveable contact arm is closed against its NC stationary contacts by the pusher while the opposite moveable arm is exerting a spring force against its NC stationary contacts. This moveable arm spring force is developed by the moveable arm acting as a cantilever spring from its mounting post or lead while the pusher applied force is created by the magnetic field created by the magnet or the energization of the coil. The magnetic force plus the spring force of the cantilevered opposite moveable arm must be overcome in order to close the contacts of the opposite moveable arm with its NO stationary contacts. Additionally, all moveable contacts must exert a force against its corresponding stationary contacts with a sufficient amount of pressure to create a proper electrical connection.

In known relay constructions, the magnetic or the electromagnetic force created by the energization of the coil will move the pusher assembly alternately against both portions of the respective bifurcated moveable arm (see FIG. 1*a*). As a pusher assembly moves the moveable contact arm to create the electrical connection with its pusher applied stationary contacts, the moveable arm no long resembles a simple cantilever beam. As can be seen in FIG. 1*c*, the moveable arm is comparable to a beam constrained at one end and supported at the opposite end. The force of the pusher assembly is applied between the two ends of this flexible beam which in this position is extremely stiff. This stiffness makes it difficult to achieve sufficient overtravel of the pusher against the moveable arm to maintain the necessary contact presure for a proper electrical connection between the moveable and pusher applied stationary contacts.

The necessary contact pressure to close the moveable arm with its respective pusher applied stationary contacts is normally created by an overtravel of the pusher assembly against the moveable contact arm past the point of the contacts touching. Location tolerances cause a wide variation in the amount the pusher assembly must travel against the moveable arm beyond the point of closing of these stationary contacts. Any variation in the position of the pusher assembly against the moveable arm causes a wide variation in the force required to operate the relay.

Another complicating factor in the design of this type relay is the stiff resistance of the moveable arm when engaged by the pusher assembly in a direction that is not strictly perpendicular to the plane of the moveable arm. This is a condition often found in these relays due to the tolerance problems created during mass production. Complicating this design problem is the fact that a reduction in the spring rate of the moveable arm, in order to reduce the force required to close the pusher applied stationary contacts, tends to lower the spring force closing the set stationary contacts to a level that is insufficient for proper electrical connection.

The non-variable factor in this design problem is the minimum distance which must separate open contacts in order to eliminate the possibility of electrical arcing between these contacts.

The typical designs of a bifurcated moveable contact arm (FIG. 1*a–c*) have serious shortcomings which lead to performance failures in this type relay and which greatly affect the useful life of these relays. First, when the spring rate of the moveable arm exceeds the rate of force change of the electromagnetic system, the system will move in an erratic manner after energization of the coil. Additionally, the spring rate of the moveable arm will affect the electrical connection of the contacts. A stiff spring rate normally causes the contacts to bounce excessively and can lead to chattering. The limiting of the bounce also decreases the likelihood of arcing during the connection of the moveable contacts with the stationary contacts.

Secondly, a high spring rate of the moveable arm and the amount of overtravel required to overcome the design tolerances, both create excessive resistance forces against magnet and the electromagnetic system. These resistance forces often cause the system to "stall out" prior to the armature and pusher assembly closing against the magnetized pole pieces. The "stall out" condition primarily exists when the spring rate of the arm opposing magnetic force resists the closure or pusher applied force. When the switching or pusher applied force cannot overcome the resistance forces the contacts will not move to closure on the opposite stationary contact. Also, when there are high resistance forces the pull-in and drop-out voltages become erratic and cause arcing during separation. This condition is mainly due to the fact that the contacts are separated slowly since the electromagnetic force takes time to overcome the resistance forces.

Reliable relay operation is greatly dependent on the interrelation of its moving parts with respect to the position of the stationary contacts and leads. Reliability, also, becomes a problem after the relay is in use for an extended period of time. Constant movement of the parts combined with the internal operating forces to insure proper electrical interconnection often cause a misalignment of the stationary parts. These particular problems typically become apparent only after the relay is in use for an extended period of time.

The commonly assigned co-pending Pat. application Ser. No. 698,301 relate to a method of manufacturing and assembling this type relay. This method insures that the critical positioning of the stationary parts is not affected by the remaining assembly processes. This method also insures that the assembly remains as prepositioned for the life of the relay. The present invention relates to a structure of a moveable contact arm and its associated pusher assembly within this prepositioned relay. This invention cures many of the operational problems found in the prior art of this type relay.

Therefore, it is the object of this invention to provide a miniature electromagnetic relay which overcomes the problems of the prior art of this type relay.

Also, it is the object of this invention to provide a miniature relay which is produced simply and a low cost, which results in a highly reliable product even after numerous operations.

In particular, it is the object of this invention to provide a new and novel bifurcated moveable contact arm and electromagnetic pusher assembly which reduce the critical tolerance requirements of these interacting electrical connecting parts to substantially increase the reliability and longevity of the relay operation.

The preferred embodiment of the electromechanical miniature relay comprises a molded insulative base having terminal pins and corresponding electrically connected contact and coil leads molded and prepositioned into the base. The base retains a permanent magnet and two pole pieces. Mounted on the base is an electromagnetic coil through which is positioned a moveable armature. The armature contacts one pole piece and extends through the coil between the stationary contact leads. Mounted on the armature is a pusher assembly which transfers the motion of the armature against the moveable contact arms with the energization of the coil electromagnetic block.

The preferred embodiment of the invention operates by the magnetic and the electromagnetic forces being applied by the pusher assembly at a single point on the moveable contact arm such that both bifurcated contacts on the moveable close simultaneously. The moveable contact arm receives this force on a tab located between the bifurcated contact carrying members. This tab is cantilevered with respect to the main portion of the moveable arm such that when the pusher assembly is operated against the tab which flexes to create the required overtravel force to close both contacts against the pusher applied stationary contacts. This arrangement resists the electromagentic forces with a considerably lower spring rate in overtravel and solves the problems of conventional designs mentioned above such as bouncing or chattering.

Two alternative versions of applying this point force against the tab of the moveable arm are discussed and claimed in detail below. The first embodiment comprises a pusher assembly having a flat section which engages the tab of the moveable arm. The tab has a dimple which extends out from the tab surface towards the pusher assembly. The second alternate version of this invention comprises a flat tab having a smooth surface which is contacted by a pusher assembly having a ball or rounded end. Both of these embodiments move the contact arm by a single point force against the tab which, because of the curvature of the dimple or the ball, applies the electromagnetic force in a direction which is always normal to the surface of the tab. Application of the point force in this manner eliminates the problems created by uneven pressure against the bifurcated contact arm after a misalignment of the pusher assembly.

Further objects and advantages of this invention will become apparent upon particularly describing the preferred embodiments of the invention within this type relay, however, the disclosure of this invention should not be limited to these particular embodiments described and claimed.

DETAILED DESCRIPTION OF THE INVENTION

Figure 2:
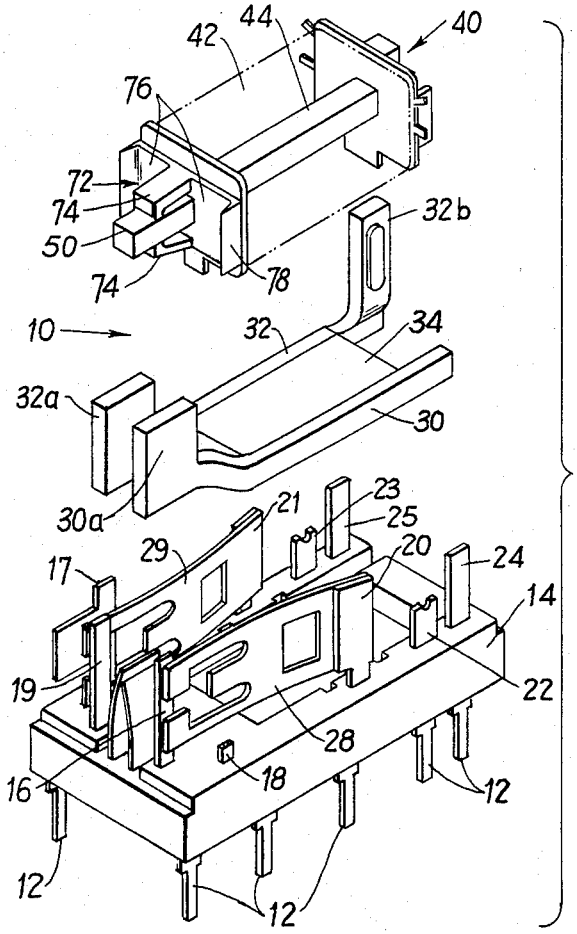
FIG. 2-shows an exploded view of a relay as contemplated by this disclosure having one embodiment of the moveable arm and pusher assembly.
Figure 1A:
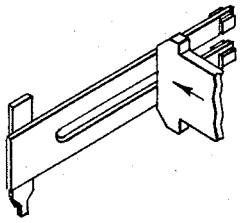
FIG. 1a PRIOR ART
FIG. 1*a,b,c*-shows three views of prior art contact arm structures.
Figure 1B:
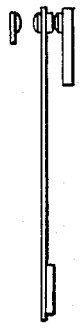
FIG. 1b PRIOR ART
Figure 1C:
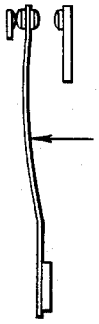
FIG. 1c PRIOR ART

FIG. 2 shows the parts of a typical relay 10 in exploded view to indicated the relationship of these parts in the assembly. The relay 10 has a series of terminal pins 12 which are mounted on the bottom of a base 14. The base, typically an insulative thermoplastic material, is formed by an injection molding process around the pins 12. The pins are electrically connected to various leads which extend above the base 14 opposite of the pins 12 and are also molded into the base.

The pins 12 are used to mount the relay to a printed circuit board (not shown). The leads are specifically designated as the NC stationary contact leads 18 and 19, the NO stationary contact leads 16 and 17, the movable arm leads 20 and 21, and the coil leads 22–25. Each lead 16–25 is electrically interconnected to a pin and set into the base 14 during the molding process. All of the parts are permanently mounted in their desired position during molding process to achieve proper relay operation.

Mounted within a recess of the base 14 are two pole pieces 30, 32 and a permanent magnet 34. The pole pieces 30, 32 are in contact with the magnet 34 when inserted into recesses of the base but are insulated from the pins and leads by the material of the base 14. This arrangement creates a magnetic gap between the two upper extensions 30*a*, 32*a*, of the pole pieces 30, 32.

The electromagnetic block 40, which comprises a coil 42 wrapped on a bobbin 44, is mounted on the upper surface of the base 14 between the respective leads 23, 25 and 22, 24. An armature 50 is passed through the bobbin 44 and disposed at one end between the two upper extensions 30*a*, 32*a* of the pole pieces 30, 32. The armature 50 is held at its opposite end against the rear extension 32*b* of pole piece 32. A clip (not shown) of is used to maintain the contact between these two points.

The energization of the electromagnetic block 40 causes motion of the armature 50 from one pole piece 30*a* to the other 32*a*. In the NC position, the permanent magnet 34 pulls the armature towards one pole piece (30 as shown in FIG. 2). Upon an excitation of the coil 42, the magnetic field produced by the coil will overcome the permanent magnet magnetic field and cause the armature 50 to be attracted to the opposite pole piece 32*a* to place the relay 10 in the NO position (FIG. 3*b*).

The relay 10 shown in FIG. 2 comprises two sets of contacts 16, 18 and 17, 19 and two moveable contact arms 28, 29. Thus, the relay 10 performs two electrical switching operations with each shift in the armature 50. however, each of the switch operations are identical in nature.

Figure 3A:
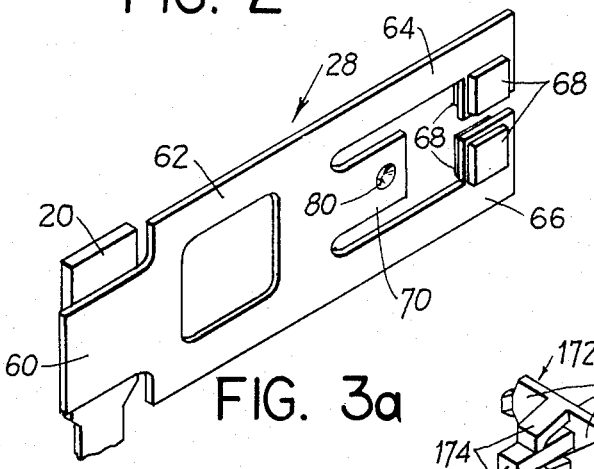
FIG. 3-shows a profile view of this invention showing the tab in overtravel during closure of the NO contacts.

As seen in FIG. 3*a*, the moveable contact arms 28, 29 of the invention each comprise a mounting portion 60 which is attached to the moveable arm leads 20,21, respectively; a center portion 62; two contact carrying portions 64,66 extending from the center portion 62 and ending in contact buttons 68 mounted on both sides of the carrying portions 64,66; and a tab 70 which extends from the center portion 62 between the contact carrying portions 64,66.

Figure 3B:
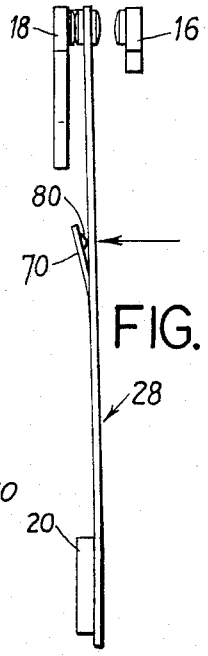

As can be seen in the profile view of the moveable arm 28 in FIG. 3*b* the tab 70 is cantilevered on the center portion 62 and acts to move the entire moveable arm 70 from the NC contact 18 to the NO contact 16.

The movement of the moveable arms 28,29 is caused by the switching motion of the armature 50. Mounted on this armature 50 is a pusher assembly 72, as seen in FIG. 2 which extends laterally from each side of the armature to contact the tab 70 of the moveable arms 28,29. In one embodiment (FIG. 2), the pusher assembly 72 has two gripper arms 74 which hold the assembly to the armature 50. Also, the assembly has two extensions 76 each having a pusher flat 78 which contacts the tab 70 of a movable arm 28, 29.

In this embodiment the tab 70 is further provided with a dimple 80 which is formed on the surface of the tab to extend towards the pusher assembly 72. This dimple 80 contacts the pusher flat 78 of the assembly extensions 76 so that the contact area is substantially a point contact.

In the ideal situation, the pusher flat 78 would be positioned so that the motion of the armature 50 would contact the moveable arms 28,29 in a direction normal to the plane of the movable arms 28,29. However, if any misalignment of these parts as assembled takes place this embodiment will still move the contact arm 28,29 with point force and will push the tab at a substantially perpendicular direction. Therefore, no twisting of the moveable arm 28,29 takes place, thus, even contact pressure or both contacts is maintained.

Figure 4:
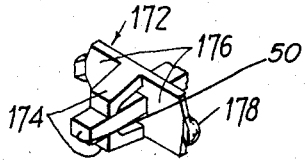
FIG. 4-shows the alternate embodiment of the pusher assembly of this invention.

In the alternate embodiment seen in FIG. 4, the pusher assembly 172 comprises two gripper arms 174 which hold the assembly onto the armature 50 and further comprises two extensions 176 which terminate in a pusher ball 178. In this embodiment the tab 70 of the moveable arm 28,29 is not supplied with a dimple but rather has a smooth surface. Upon motion of the armature 50 the pusher assembly 172 contacts the tab 70 by way of the pusher ball 178. The pusher ball 178 has a rounded surface and contacts the tab 70 at substantially a point area. This second embodiment has the same function as the previous version such any misalignment of the parts will not cause a substantial change in the direction or manner of applying the pushing force.

What is claimed is:

1. A miniature electromagnetic relay of the type used in the telecommunications industry, comprising a base of electrical insulating material, a relay contact set having leads that electrically connect with respective terminals in said base, said contact set having a pair of fixed contact leads that carry respective normally open and normally closed stationary contacts, said contact set also including a movable contact lead and a movable contact arm positioned between respective stationary contacts, said movable contact arm having a mounting end attached to said movable contact lead and having two spaced, parallel, elongated contact carrying portions extending from said mounting and terminating in spaced ends that carry respective contacts, an integral tab extending from the mounting end of said movable contact arm and between said spaced, parallel and elongated contact carrying portions of a contact arm, said tab being shorter in length than the elongated contact carrying portions of the movable contact arm, magnetic pole means forming a magnetic gap at one end of said base, an armature having one end in said magnetic gap, means for producing an electromagnetic force for selectively moving said armature in said magnetic gap, a pusher assembly mounted on said armature and arranged to engage the tab if said movable contact arm at a point of contact substantially perpendicular to the plane of said tab, said armature being arranged to selectively move from one side of said magnetic gap to the opposite side depending upon the direction of said electromagnetic force, and the motion of said armature and said pusher assembly against said tab causing the contacts on the movable contact arm to selectively engage stationary contacts on said fixed contact leads.

2. The relay claimed in claim 1 wherein the two contact carrying portions of the movable arm lie substantially in a common plane, the properties of said tab and the force applied by the pusher assembly being selected so that the tab is bent through said plane of the two contact carrying portions when the pusher assembly pushes the tab to and beyond the position where the contacts on the movable contact arm physically contact the normally open stationary contacts.

3. The relay claimed in claim 2 wherein said movable contact arm has an aperture in the portion thereof between its mounting end and said tab.

4. The miniature electromagnetic relay claimed in claim 1 and including a second relay contact set substantially identical to the recited set and positioned on said base so that the pusher assembly causes both movable arms to move each time said armature moves.

* * * * *